US005994796A

United States Patent [19]

De Los Santos

[11] Patent Number: 5,994,796

[45] Date of Patent: Nov. 30, 1999

[54] SINGLE-POLE SINGLE-THROW MICROELECTRO MECHANICAL SWITCH WITH ACTIVE OFF-STATE CONTROL

[75] Inventor: Hector J. De Los Santos, Inglewood, Calif.

[73] Assignee: Hughes Electronics Corporation, El Segundo, Calif.

[21] Appl. No.: 09/128,642

[22] Filed: Aug. 4, 1998

[51] Int. Cl.[6] ..... H01H 19/64

[52] U.S. Cl. ..... 307/113; 307/112; 307/116; 307/125

[58] Field of Search ..... 307/44, 69, 80, 307/85, 86, 112, 116, 125, 126, 130, 131, 132, 139, 140; 361/139, 160, 170; 200/175, 19 R; 335/78, 106; 327/69, 77

[56] References Cited

U.S. PATENT DOCUMENTS

| | | | |
|---|---|---|---|
| 4,899,068 | 2/1990 | Klose et al. | 327/89 |
| 4,959,515 | 9/1990 | Zavracky et al. | 200/181 |
| 5,113,090 | 5/1992 | Imaizumi et al. | 327/89 |
| 5,258,591 | 11/1993 | Buck | 200/181 |
| 5,278,368 | 1/1994 | Kasano et al. | 200/181 |
| 5,381,053 | 1/1995 | Yasuda | 327/65 |
| 5,638,946 | 6/1997 | Zavracky | 200/181 |
| 5,757,319 | 5/1998 | Loo et al. | 342/375 |

*Primary Examiner*—Jeffrey Gaffin
*Assistant Examiner*—Peter Zura
*Attorney, Agent, or Firm*—Georgann S. Grunebach; M. W. Sales

[57] ABSTRACT

A microelectromechanical switch having a beam cantilevered from a switch base, a first control electrode, having no path to ground, in contact with the fixed end of the cantilevered beam and a second control electrode, also having no path to ground, mounted to the switch base underneath the cantilevered beam, but not in contact therewith. A contact electrode is located underneath the free end of the cantilevered beam. The first and second control electrodes are manipulated to actively effect both the ON and OFF states of the microelectromechanical switch by forcing the beam in and out of contact with the contact electrode.

10 Claims, 1 Drawing Sheet

SINGLE-POLE SINGLE-THROW MICROELECTRO MECHANICAL SWITCH WITH ACTIVE OFF-STATE CONTROL

TECHNICAL FIELD

This invention relates to a microelectromechanical switch and more particularly to a cantilever beam-type microelectromechanical switch for use in microwave applications.

BACKGROUND ART

Microelectromechanical switches are used in a variety of applications and in particular for satellite communication systems with architecture that includes switching matrices and phased array antennas. It is desirable to have a switch having low-insertion loss, high-isolation, and high-switching frequency.

Presently, the microelectromechanical switches known in the prior art include a beam cantilevered from a switch base, or substrate. The beam acts as one plate of a parallel-plate capacitor. A voltage, known as an actuation voltage, is applied between the beam and an electrode on the switch base. In the switch-closing phase, or ON-state, the actuation voltage exerts an electrostatic force of attraction on the beam large enough to overcome the stiffness of the beam. As a result of the electrostatic force of attraction, the beam deflects and makes a connection with a contact, electrode on the switch base, closing the switch. Ideally, when the actuation voltage is removed, the beam will return to its natural state, breaking its connection with the contact electrode and opening the switch.

The switch-opening phase, or OFF-state, is not directly controlled, however, and relies on the forces of nature embodied in the spring constant of the beam to effect the opening of the switch. However, the forces of nature are not always predictable and therefore unreliable.

For example, in some cases, once the actuation voltage is removed, stiction forces, (forces of attraction that cause the beam to stick to the contact electrode), between the beam and the contact electrode overcome the spring restoring force of the beam. This results in the free end of the beam sticking to the contact electrode and keeping the switch closed when, in fact, it should be open. Prior art cantilever beam type switches have no mechanism to overcome stiction forces upon switching to the ON-state.

Another problem associated with the cantilever beam type switch is a problem intrinsic to the beam's change of state from open to close. The operation of the beam is inherently unstable. When closing, the beam deforms gradually and predictably, up to a certain point, as a function of the actuation voltage being applied to the switch. Beyond that point, control is lost and the beam's operation becomes unstable causing the beam to come crashing down onto the secondary electrode. This causes the beam to stick as described above, or causes premature deterioration of the contact electrode. Both conditions impair the useful life of the switch and result in premature failure.

There is a need for a microelectromechanical switch that overcomes the problems associated with prior art cantilevered beam-type switches.

SUMMARY OF THE INVENTION

The microelectromechanical switch of the present invention exploits the repulsive Coulomb electrostatic force between a cantilevered beam and a contact electrode to actively induce the beam to its undeflected state, whereby the OFF-state action of the switch is independent of the stiffness, or spring constant, of the beam.

According to the present invention, a beam is cantilevered from a switch base, or substrate. A first control electrode, having no path to ground, is in contact with the fixed end of the cantilevered beam. A second control electrode, also having no path to ground, is mounted to the switch base underneath the cantilevered beam, but is not in contact with it. Finally, a contact electrode is located underneath the free end of the cantilevered beam. The first and second control electrodes are manipulated to actively effect both the ON and OFF states of the switch by forcing the beam in and out of contact with the contact electrode.

The first and second control electrodes are manipulated by a control circuit that applies a control voltage differentially to the first and second electrodes to result in an actuation voltage that causes the beam to deflect and contact the contact electrode actively effecting the ON-state. The control circuit, with the control voltage set to zero, applies a supply voltage simultaneously to the first and second electrodes, resulting in a Coulomb force of repulsion that returns the beam to its undeflected state, thereby actively effecting the OFF-state of the microelectromechanical switch.

It is an object of the present invention to overcome the drawbacks associated with prior art beam-type microelectromechanical switches.

A more complete understanding of the present invention can be determined from the following detailed description of the preferred embodiment, when taken in view of the attached drawings and attached claims.

BEST MODES FOR CARRYING OUT THE INVENTION

Figure 1:
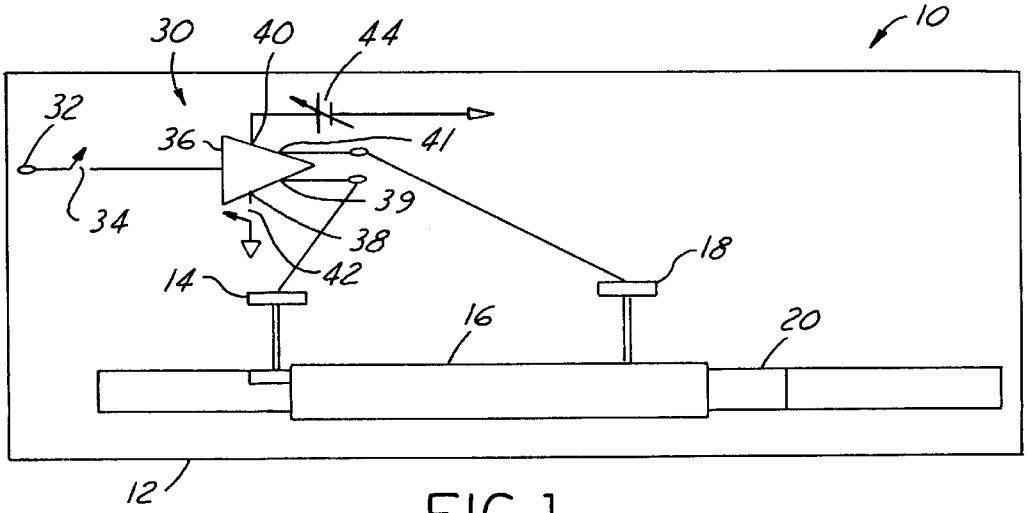
FIG. 1 is a top view of the microelectromechanical switch of the present invention with the control circuit shown in an exploded view.
Figure 2:
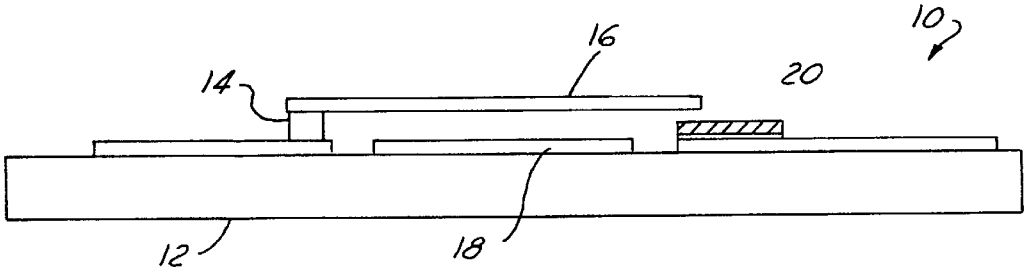
FIG. 2 is a side view of the microelectromechanical switch of the present invention.

Referring to FIGS. 1 and 2 there is shown a microelectromechanical beam-type switch 10 in accordance with the present invention. The switch 10 is a single-pole single-throw switch with active OFF-state control. A base 12 or substrate is shown having a first control electrode 14 mounted thereto. The first control electrode 14 is in contact with a beam 16 cantilevered from the base 12. A second control electrode 18 is mounted to the base 12 directly underneath, but not in contact with, the cantilevered beam 16. A contact electrode 20 is mounted to the base 12 directly beneath the free end of the cantilevered beam 16. A control circuit 30 is connected to both the first control electrode 14 and the second control electrode 18 for manipulating the electrodes 14, 18 in such a manner to actively induce the ON and OFF states of the microelectromechanical switch 10.

The control circuit 30 includes a control voltage 32 connected to a first switch 34. The first switch 34 is shown as a DC switch. However, one skilled in the art would recognize that the DC switch can be replaced with other comparable switches, such as a metal oxide semiconductor pass transistor. The first switch 34 is connected to the input of an operational amplifier 36 having two DC supply terminals 38,40, and two output signal terminals 39,41. DC supply terminal 38 is connected to a second switch 42 and output signal terminal 39 is connected to the first control electrode 14. The other DC supply terminal 40 is connected to a supply voltage 44 and the output signal terminal 41 is connected to the second control electrode 18.

The first control electrode 14 and the second control electrode 18 have no path to ground and are therefore "floating". This allows the control electrodes 14, 18 to be driven differentially.

To activate the ON-state, both the first switch 34 and the second switch 42 must be closed. The control voltage 32 is increased resulting in an actuation voltage being applied differentially between the first control electrode 14 and the second control electrode 18. Once the actuation voltage reaches a threshold value, the beam 16 will deform and make contact with the contact electrode 20 thereby actively effecting the ON-state of the microelectromechanical switch 10.

To activate the OFF-state, the control voltage 32 is set to zero so that the output differential voltages of the first control electrode 14 and the second control electrode 18 with respect to ground are also equal to zero. Then, with the first and second switches 34, 42 open, the supply voltage 44 is increased. The potential at the first and second control electrodes 14, 18 are increased simultaneously. Because the first and second control electrodes 14, 18 are at a given potential with respect to ground and have the same polarity, they will be acquiring charges of the same type and experience a Coulomb force of repulsion. The force is determined by the potential applied to the control electrodes 14, 18 and will be such that the force of repulsion will overcome the stiction force of the beam 16 and the contact electrode 20, thereby breaking contact between the two elements. As a result, the beam 16 is returned to its undeflected state and the microelectromechanical switch 10 will be returned to its OFF-state.

The microelectromechanical switch 10 of the present invention exploits the repulsive Coulomb electrostatic force between the beam 16 and the contact electrode 20 to actively induce the beam 16 to return to its undeflected state. The OFF-state switching action is independent of the stiffness, or spring constant, of the beam 16, thereby avoiding the inherent instability and unpredictable outcomes associated with prior art microelectromechanical beam-type switches.

The microelectromechanical switch 10 of the present invention realizes low-insertion loss, high-isolation, and high-switching frequency without the drawbacks associated with prior art switches. The switch 10 of the present invention actively counters the stiction forces, which, in prior art switches, may keep the switch in the ON-state even after the control voltage is removed.

The opening of the switch 10 is controlled by the electrostatic action, or moment, about the fixed end of the cantilevered beam 16. Because the switch 10 actively controls the restoring force of the beam and does not rely on the unpredictable, and sometimes unstable, forces of nature, the problem of sticking that is common in prior art beam-type switches is overcome.

Figure 3:
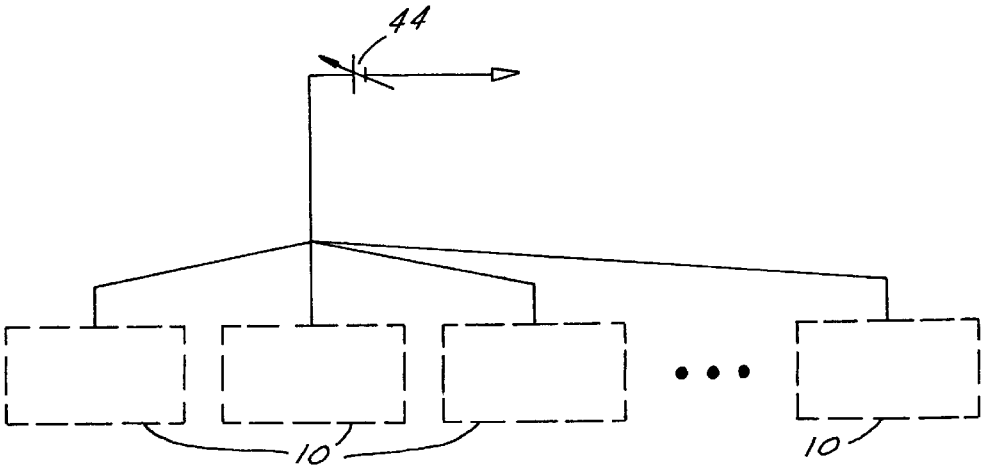
FIG. 3 is a view of a programmable power supply driving a plurality of microelectromechanical switching devices of the present invention.

While the form of the invention herein disclosed is presently the preferred embodiment, many others are possible. It is not intended herein to mention all of the possible equivalent forms or ramifications of the invention. It is understood that the terms used herein are merely descriptive rather than limiting, and that various changes may be made without departing from the spirit or scope of the invention, as defined by the appended claims. For example, metal-oxide semiconductor pass transistors may be used for the first and second switches 34. Likewise, there are a variety of operational amplifiers that can be employed, such as a complementary metal oxide semiconductor (CMOS) operational amplifier. Finally, it is possible the control voltage is a programmable supply capable of serving a plurality of microelectromechanical switches of the present invention as shown in FIG 3. Other changes and substitutions can also be made in accordance with the scope of the present invention as defined by the following claims.

What is claimed is:

1. A device for repeatedly closing and opening an electric circuit, said device comprising:

a base;

a beam cantilevered from said base, said beam having a free end and a fixed end;

a first electrode mounted to said base and in contact with said beam;

a second electrode mounted to said base;

a contact electrode mounted to said base under said free end of said beam;

a control voltage;

a first switch connected to said control voltage;

a differential operational amplifier having an input connected to said first switch, said differential operational amplifier having two supply terminals and at least two outputs, said first output connected to said first electrode and said second output connected to said second electrode;

a variable power supply voltage connected to one of said supply terminals of said operational amplifier and said first electrode; and a second switch connected to the other of said supply terminals of said differential operational amplifier whereby when said first and second switches are closed, an increase in said control voltage will result in said actuation voltage being applied differentially between said first and second electrodes closing said electrical circuit and whereby when said control voltage is zero and said first and second switches are open, an increase in said supply voltage will result in said actuation voltage being applied simultaneously between said first and second electrodes opening said electric circuit.

2. The device as claimed in claim 1 wherein said first and second switches are direct current switches.

3. The device as claimed in claim 1 wherein said first and second switches are metal-oxide semiconductor pass transistors.

4. The device as claimed in claim 1 wherein said differential operational amplifier is a complementary metal oxide semiconductor operational amplifier.

5. A microelectromechanical device for repeatedly closing and opening an electric circuit, said device comprising:

a base;

a beam cantilevered from said base, said beam having a free end and a fixed end;

a first electrode mounted to said base an in contact with said beam;

a second electrode mounted to said base;

a contact electrode mounted to said base under said free end of said beam;

a control voltage;

a first switch connected to said control voltage;

a differential operational amplifier having an input connected to said first switch, said differential operational amplifier having two supply terminals and at least two outputs, one of said at least two outputs connected to said first electrode and the other of said at least two outputs connected to said second electrode;

a variable supply voltage connected to one of said two supply terminals of said operational amplifier; and a second switch connected to the other of said two supply terminals of said differential operational amplifier;

whereby when said first and second switches are closed, an increase in said control voltage will result in said actuation voltage being applied differentially between said first and second electrodes closing said electrical circuit and whereby when said control voltage is zero and said first and second switches are open, an increase in said supply voltage will result in said actuation voltage being applied simultaneously between said first and second electrodes opening said electric circuit.

6. The device as claimed in claim 5 wherein said variable power supply is a programmable power supply.

7. The device as claimed in claim 6 wherein said programmable power supply drives a plurality of said microelectromechanical switching devices.

8. The device as claimed in claim 5 wherein said first and second switches are direct current switches.

9. The device as claimed in claim 5 wherein said first and second switches are implemented by a metal-oxide semiconductor pass transistor.

10. The device as claimed in claim 5 wherein said differential operational amplifier is a CMOS operational amplifier.

* * * * *